US010889120B2

(12) United States Patent
Shimano

(10) Patent No.: US 10,889,120 B2
(45) **Date of Patent: *Jan. 12, 2021**

(54) IMAGE RECORDING APPARATUS

(71) Applicant: BROTHER KOGYO KABUSHIKI KAISHA, Nagoya (JP)

(72) Inventor: Ayaka Shimano, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,836

(22) Filed: Mar. 14, 2018

(65) Prior Publication Data

US 2018/0281427 A1 Oct. 4, 2018

(30) Foreign Application Priority Data

Mar. 31, 2017 (JP) ..... 2017-072917

(51) Int. Cl.

| | |
|---|---|
| ***B41J 29/38*** | (2006.01) |
| ***B41J 2/175*** | (2006.01) |
| ***B41J 29/13*** | (2006.01) |
| *B67D 7/32* | (2010.01) |
| *B67D 7/02* | (2010.01) |

(52) U.S. Cl.

CPC ..... *B41J 2/17509* (2013.01); *B41J 2/1752* (2013.01); *B41J 2/1754* (2013.01); *B41J 2/17566* (2013.01); *B41J 29/13* (2013.01); *B41J 29/38* (2013.01); *B67D 7/02* (2013.01); *B67D 2007/329* (2013.01)

(58) Field of Classification Search

CPC ..... B41J 2/175; B41J 2/17566; B41J 2/1754

See application file for complete search history.

(56) References Cited

U.S. PATENT DOCUMENTS

| | | | | |
|---|---|---|---|---|
| 2003/0075156 | A1* | 4/2003 | Morinaga | F02M 25/0809 123/520 |
| 2012/0044285 | A1* | 2/2012 | Ogasawara | B41J 2/175 347/6 |
| 2013/0008533 | A1* | 1/2013 | Kato | H01M 10/48 137/551 |
| 2015/0352853 | A1 | 12/2015 | Kudo et al. | |

FOREIGN PATENT DOCUMENTS

| | | | |
|---|---|---|---|
| JP | 2016000505 | A | 1/2016 |
| WO | WO 2014/112344 | A1 | 7/2014 |

* cited by examiner

*Primary Examiner* — Lam S Nguyen

(74) *Attorney, Agent, or Firm* — Scully, Scott, Murphy & Presser, P.C.

(57) ABSTRACT

An image recording apparatus includes a tank, a cap, a cap detector, a notification device, and a controller. The tank is configured to store ink therein. The tank is formed with a filling port for filling ink. The cap is configured to be attached to the filling port so as to close the filling port. The cap detector is configured to detect whether the cap is attached to the filling port. The notification device is configured to output particular information. The controller is configured to control the notification device to output a warning, in response to determining based on a detection signal of the cap detector that a particular period or longer has elapsed in a state where the cap is detached from the filling port.

9 Claims, 8 Drawing Sheets

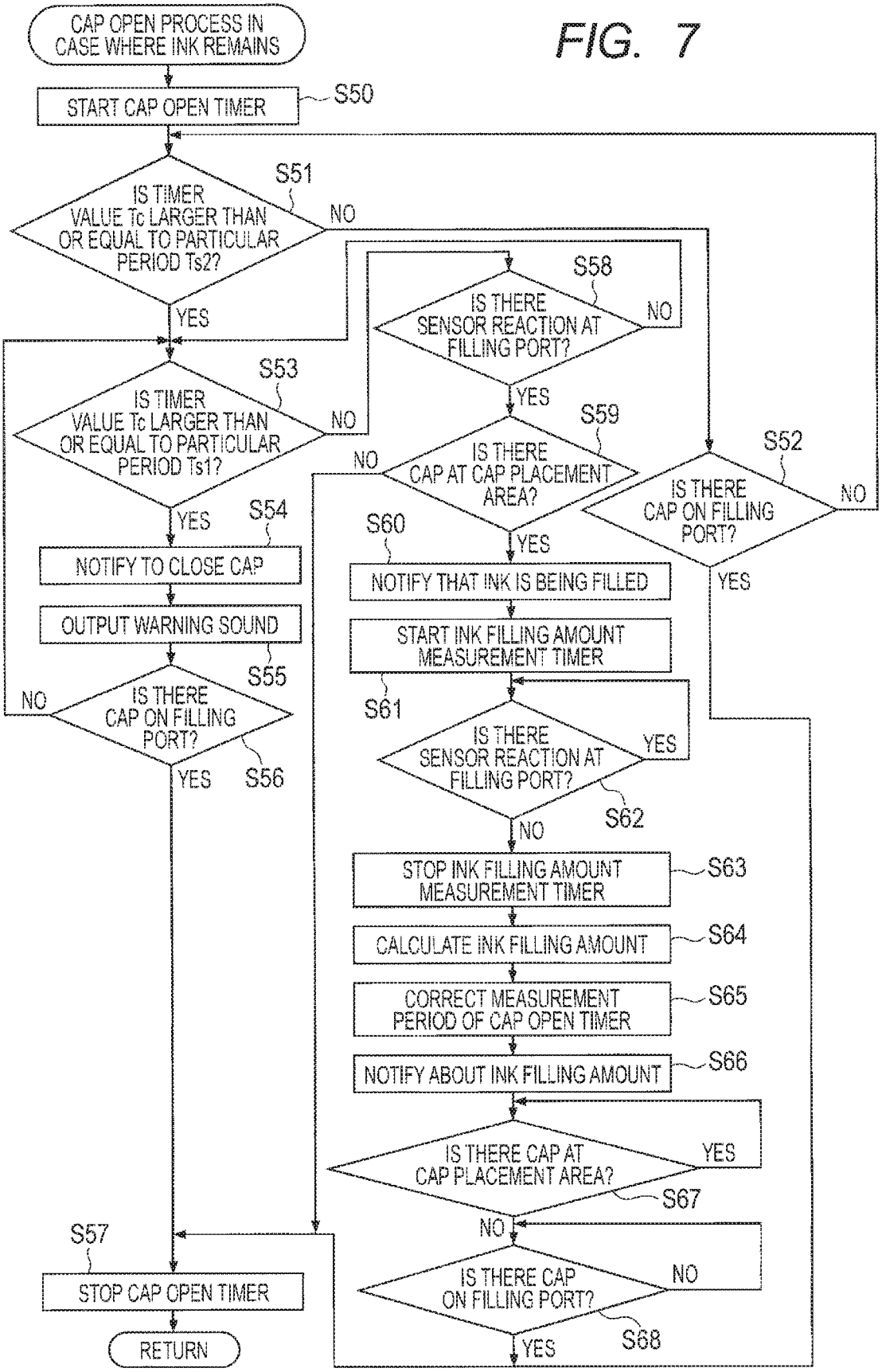
FIG. 7
CAP OPEN PROCESS IN CASE WHERE INK REMAINS
START CAP OPEN TIMER
S50
IS TIMER VALUE Tc LARGER THAN OR EQUAL TO PARTICULAR PERIOD Ts2?
S51
NO
YES
IS TIMER VALUE Tc LARGER THAN OR EQUAL TO PARTICULAR PERIOD Ts1?
S53
NO
YES
NOTIFY TO CLOSE CAP
S54
OUTPUT WARNING SOUND
IS THERE CAP ON FILLING PORT?
S55
NO
YES
S56
STOP CAP OPEN TIMER
S57
RETURN
IS THERE SENSOR REACTION AT FILLING PORT?
S58
NO
YES
IS THERE CAP AT CAP PLACEMENT AREA?
S59
NO
YES
IS THERE CAP ON FILLING PORT?
S52
NO
YES
NOTIFY THAT INK IS BEING FILLED
S60
START INK FILLING AMOUNT MEASUREMENT TIMER
S61
IS THERE SENSOR REACTION AT FILLING PORT?
YES
S62
NO
STOP INK FILLING AMOUNT MEASUREMENT TIMER
S63
CALCULATE INK FILLING AMOUNT
S64
CORRECT MEASUREMENT PERIOD OF CAP OPEN TIMER
S65
NOTIFY ABOUT INK FILLING AMOUNT
S66
IS THERE CAP AT CAP PLACEMENT AREA?
YES
S67
NO
IS THERE CAP ON FILLING PORT?
NO
S68
YES

IMAGE RECORDING APPARATUS

CROSS REFERENCE TO RELATED APPLICATIONS

This application claims priority from Japanese Patent Application No. 2017-072917 filed Mar. 31, 2017. The entire content of the priority application is incorporated herein by reference.

TECHNICAL FIELD

This disclosure relates to an image recording apparatus.

BACKGROUND

As an example of an image recording apparatus, a printer is conventionally known that includes a tank in which ink is stored and that ejects, from nozzles, the ink supplied from the tank so as to record an image on a recording sheet. The tank is formed with a filling port through which ink can be filled, for example. The filling port is closed by a cap that is detachably attached to the filling port.

SUMMARY

According to one aspect, this specification discloses an image recording apparatus. The image recording apparatus includes a tank, a cap, a cap detector, a notification device, and a controller. The tank is configured to store ink therein. The tank is formed with a filling port for filling ink. The cap is configured to be attached to the filling port so as to close the filling port. The cap detector is configured to detect whether the cap is attached to the filling port. The notification device is configured to output particular information. The controller is configured to control the notification device to output a warning, in response to determining based on a detection signal of the cap detector that a particular period or longer has elapsed in a state where the cap is detached from the filling port.

BRIEF DESCRIPTION OF THE DRAWINGS

Embodiments in accordance with this disclosure will be described in detail with reference to the following figures wherein:

FIG. 7 is a sub-flowchart of a cap open process in a case where ink remains in FIG. 4.

DETAILED DESCRIPTION

In the above-mentioned printer, if a user forgets to close the filling port with the cap and the filling port of the tank is kept unclosed with the cap, there is a possibility that ink vaporizes through the filling port and ink viscosity increases.

In view of the foregoing, an aspect of an object of this disclosure is to provide an image recording apparatus that suppresses a user from forgetting to close a filling port with a cap.

An aspect of this disclosure will be described while referring the attached drawings.

[External Configuration of MFP]

Figure 1A:
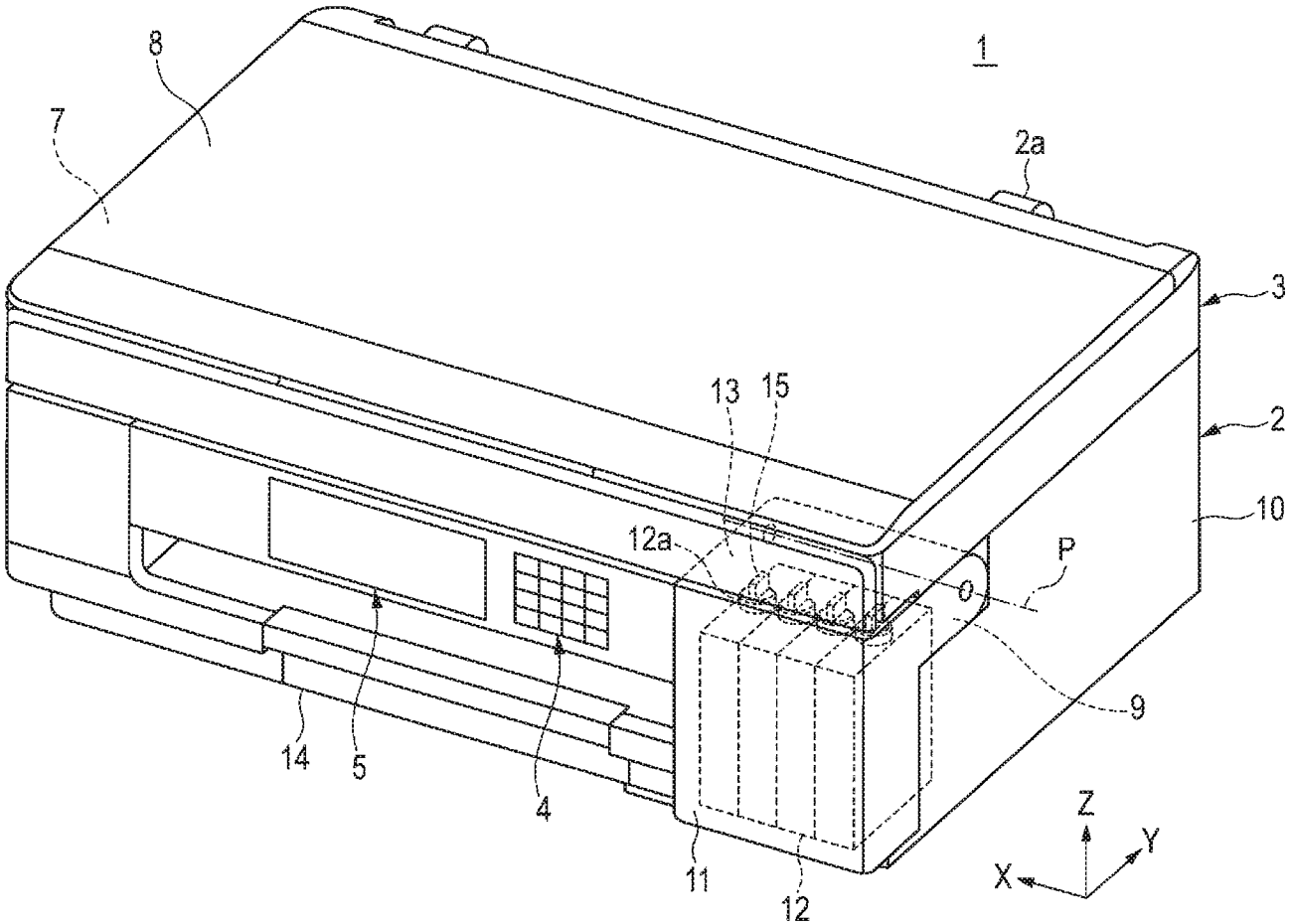
FIG. 1A is an external view of an MFP according to an embodiment.

An MFP 1 shown in FIG. 1A is an example of an image recording apparatus, and has an appearance of the shape of a rectangular parallelepiped in which an X direction is a width direction, a Y direction is a front-rear (depth) direction, and a Z direction is an up-down direction. The MFP 1 includes a printer unit (recorder or print engine) 2, a scanner unit 3, an operation key (operating interface) 4, a notification device 5, and a control unit 6 (see FIG. 2).

The scanner unit 3 reads an image with an image sensing element so as to generate image data. In the printer unit 2, the generated image data is printed on a recording sheet that is stored within the MFP 1 or is supplied from the outside of the MFP 1. The scanner unit 3 described above is arranged over the printer unit 2 and is coupled to the printer unit 2 with a coupling portion 2*a* that is provided on a rear side of the printer unit 2. Hence, when a front portion of the scanner unit 3 is lifted, the scanner unit 3 is pivotally moved upward about the coupling portion 2*a* serving as a pivot with respect to the printer unit 2, and thus the interior of the printer unit 2 is exposed. The scanner unit 3 includes an original document stage 7 and a lid 8, and the lid 8 is arranged to cover the original document stage 7. The scanner unit 3 reads an image recorded on an original document sheet in a state where the original document sheet is arranged between the original document stage 7 and the lid 8.

The operation key 4 and the notification device 5 are arranged on an outer portion (here, a front portion) of the MFP 1. The operation key 4 receives an operation input by a user. The notification device 5 notifies the user about particular information. The notification device 5 may be a display, a lamp, or a speaker, for example. Alternatively, the notification device 5 may print particular information on a sheet in order to notify the user about the particular information. The control unit 6 controls the printer unit 2, the scanner unit 3, and the notification device 5 based on an input from the operation key 4 or an external input through a communication interface (not shown).

The printer unit 2 is controlled by the control unit 6, and uses the ink supplied from a tank 12 so as to record the image on the recording sheet. The printer unit 2 includes a case 10 that forms part of the housing of the MFP 1 and that is formed in the shape of a rectangular parallelepiped. A cover 11 is attached to the case 10. The cover 11 opens and closes an opening communicating with an internal space 13 provided within the case 10. A plurality of tanks 12 is accommodated in the internal space 13. A cap 15 is detachably attached to each tank 12.

The cover 11 is provided in a front portion of the case 10 and, in the present embodiment, is coupled to the case 10 so as to pivotally move in a given range around an imaginary axis line P extending in a horizontal direction (for example, the width direction of the MFP 1). The cover 11 is opened and closed in a state where the scanner unit 3 is lifted from the printer unit 2. When the cover 11 is opened (FIG. 1B), the internal space 13 is exposed. A tray 14 in which the recording sheets are stored is arranged within the case 10. The tray 14 is pulled out forward with respect to the case 10 such that the recording sheets can be replenished. Note that the cover 11 is omitted in FIGS. 1C and 1D for simplicity.

The plurality of tanks 12 is accommodated in the internal space 13 in a state where the tanks 12 are aligned in the width direction. When the cover 11 is opened, the tanks 12 are exposed to the outside. A filling port 12*a* is formed in each tank 12, and the ink that is filled through the filling port 12*a* is stored therein. The filling port 12*a* of the tank 12 in the present embodiment is provided in an upper portion of the tank 12. The cap 15 is detachably attached to the filling port 12*a* so as to close the filling port 12*a*.

Here, when the user replenishes the ink to the tank 12 through the filling port 12*a*, a particular ink replenishment bottle 90 (see FIG. 1D) is used, and the ink flows out from the bottle opening of the bottle substantially at a constant outflow rate so as to be replenished to the tank 12. Hence, by preliminarily grasping the outflow rate of the ink from the bottle opening of the bottle, the ink filling amount can be estimated by measuring a period during which the ink is filled, for example.

As an example, the MFP 1 performs color printing, and the tanks 12 correspond to the ink of respective colors (here, black, yellow, magenta and cyan). The MFP 1 may have a single tank so as to perform only the printing of a single color.

The MFP 1 further includes a cap placement area 9 at which the cap 15 detached from the filling port 12*a* of the tank 12 is placed (see FIGS. 1A to 1D). The cap placement area 9 in the present embodiment is provided in a region of the case 10 that faces the internal space 13 and, as an example, is provided at the rear side of the filling port 12*a*. Here, the cap placement area 9 need not be necessarily provided at the rear side of the filling port 12*a*. The position at which the cap placement area 9 is provided is not limited as long as the cap placement area 9 is provided at the case 10.

[Functional Configuration of MFP]

Figure 2:
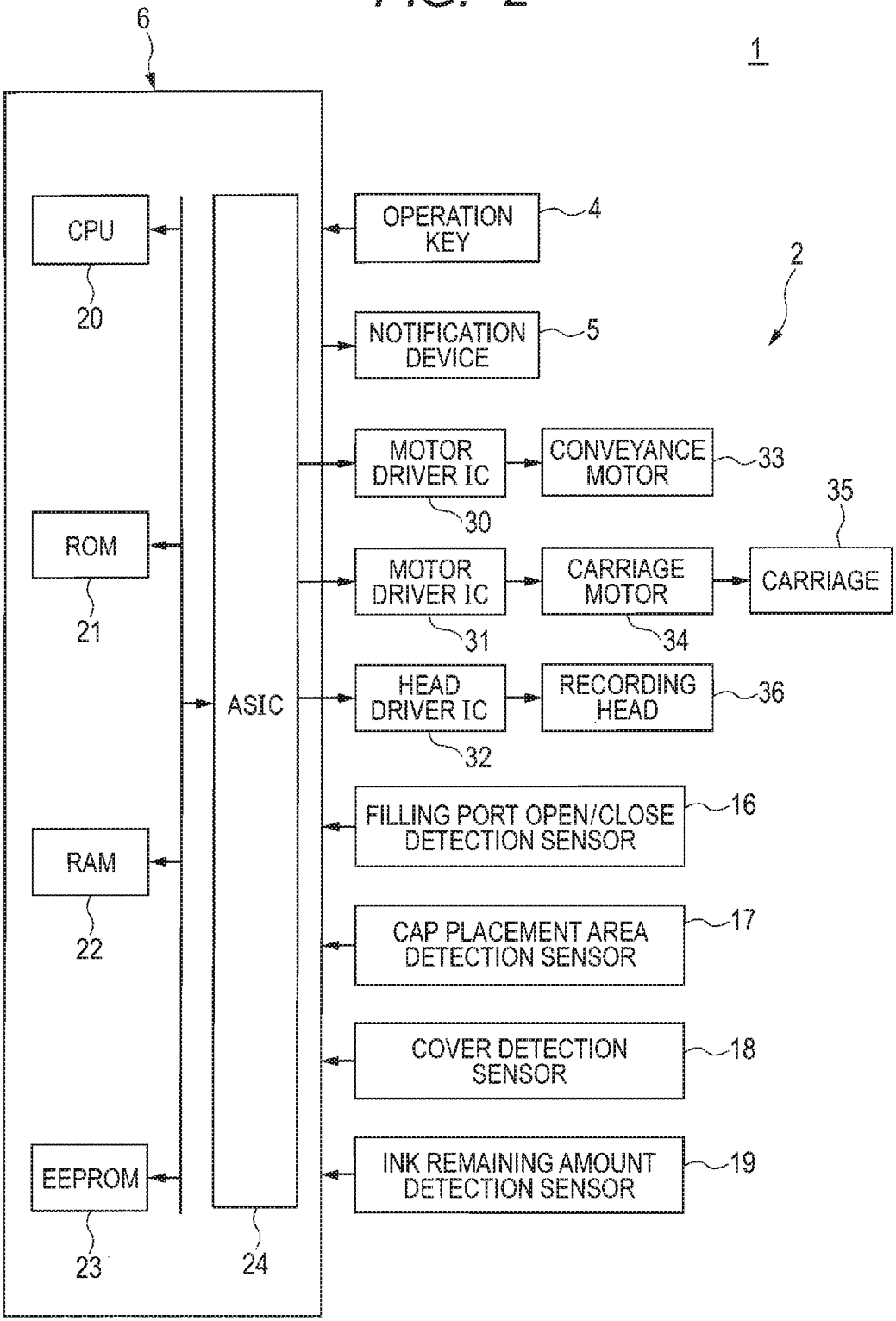
FIG. 2 is a functional block diagram of the MFP in FIG. 1A.

In FIG. 2, the illustration of the configuration of the scanner unit 3 is omitted. As shown in FIG. 2, the MFP 1 includes various sensors, drivers, and so on forming the printer unit 2 in addition to the operation key 4, the notification device 5, the control unit 6, and so on, described above.

Specifically, the printer unit 2 further includes a filling port open/close detection sensor 16, a cap placement area detection sensor 17, a cover detection sensor 18, an ink remaining amount detection sensor 19, motor driver ICs 30 and 31, a head driver IC 32, a conveyance motor 33, a carriage motor 34, a carriage 35, and a recording head 36.

The filling port open/close detection sensor 16 is a sensor for detecting whether the filling port 12*a* of the tank 12 is open or closed. Specifically, the filling port open/close detection sensor 16 detects whether the filling port 12*a* of the tank 12 is closed by any one of the cap 15 and the ink replenishment bottle 90, or the filling port 12*a* is open.

Figure 1B:
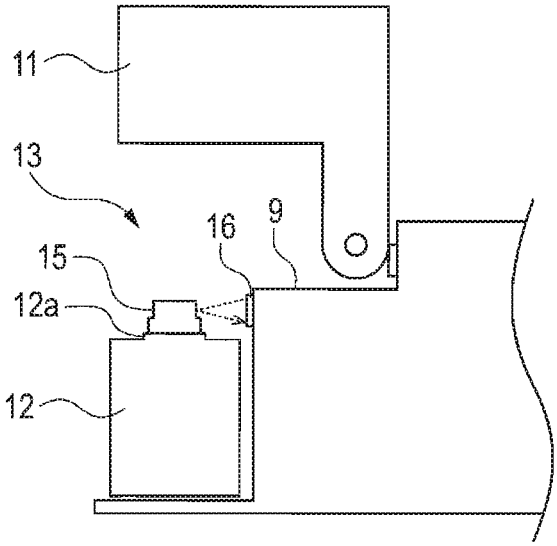
FIG. 1B is an explanatory diagram showing a state where a cap is attached to a filling port of a tank.
Figure 1C:
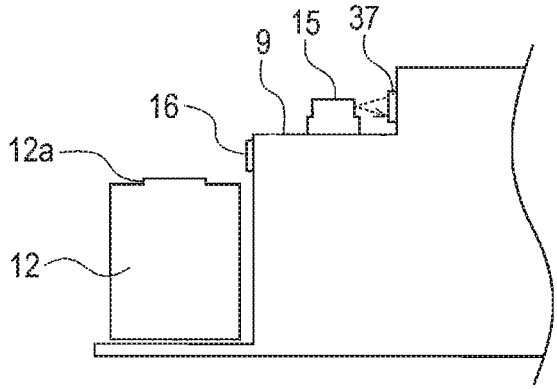
FIG. 1C is an explanatory diagram showing a state where the cap is detached from the filling port of the tank and is placed at a cap placement area.
Figure 1D:
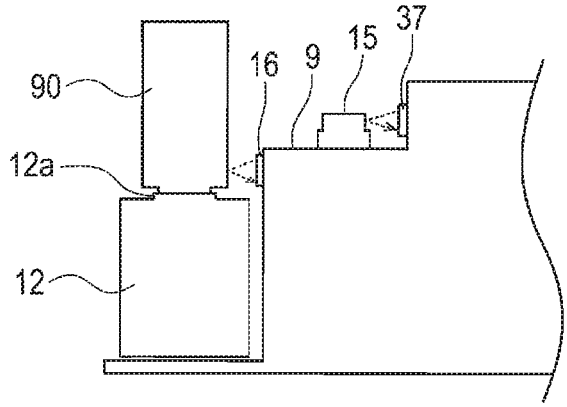
FIG. 1D is an explanatory diagram showing a state where an ink replenishment bottle is inserted in the filling port of the tank.

Various types of sensors may be used as the filling port open/close detection sensor 16, such as an optical sensor and a magnetic sensor, and the filling port open/close detection sensor 16 is not limited to a particular type of sensor. As shown in FIGS. 1B to 1D, in the present embodiment, an optical sensor is used as the filling port open/close detection sensor 16. The filling port open/close detection sensor 16 has a light emitting portion and a light receiving portion. The control unit 6 determines whether the filling port 12*a* is closed by any one of the cap 15 and the ink replenishment bottle 90, based on whether light emitted from the light emitting portion is reflected and received by the light receiving portion (FIGS. 1B, 1D). In the present embodiment, it is not distinguished, based on detection signals of the filling port open/close detection sensor 16, which of the cap 15 and the ink replenishment bottle 90 closes the filling port 12*a*. Alternatively, a magnetic sensor may be used as the filling port open/close detection sensor 16.

The cap placement area detection sensor 17 detects whether the cap 15 is placed at the cap placement area 9. Similar to the filling port open/close detection sensor 16, various types of sensors may be used as the cap placement area detection sensor 17, such as an optical sensor and a magnetic sensor, and the cap placement area detection sensor 17 is not limited to a particular type of sensor.

The filling port open/close detection sensor 16 is provided for each of the plurality of colors, and detects an open/close state of the filling port 12*a* for each color. Similarly, the cap placement area detection sensor 17 is provided for each of the plurality of colors, and detects whether the cap 15 exists at the cap placement area 9 for each color.

The cover detection sensor 18 detects whether the cover 11 is at an open position or at a closed position. The ink remaining amount detection sensor 19 detects whether the amount of ink stored in the tank 12 is smaller than a preset particular remaining amount Vs. The particular remaining amount Vs may be set as appropriate with consideration given to, for example, the number of sheets that can be printed with remaining ink in the MFP 1.

As an example, the control unit 6 includes a CPU 20, a memory (a ROM 21, a RAM 22, and an EEPROM 23) and an ASIC 24. The CPU 20 is a controller of the MFP 1 to control the driver ICs 30 to 32 and the notification device 5. The CPU 20 executes a particular program stored in the ROM 21 so as to also function as a cap open timer for measuring a period that elapses from when the cap 15 is detached from the filling port 12*a* until when the cap 15 is again attached to the filling port 12*a*, and function as an ink filling amount measurement timer for measuring the filling amount of ink into the tank 12. The CPU 20 monitors an output value (detection signal) of the sensors 16 to 19. The CPU 20 described above may be mounted on the control unit 6 as a single processor or mounted as a plurality of processors that cooperates with each other.

The ROM 21 stores a reading control program with which the CPU 20 controls the scanner unit 3 to perform a reading process on an image on an original document sheet and a printing control program with which the CPU 20 controls the printer unit 2 to perform a printing process. The EEPROM 23 stores various types of initial setting information inputted by the user. The motor driver ICs 30 and 31 and the head driver IC 32 are connected to the ASIC 24.

When the CPU 20 receives a print job from the user, the CPU 20 outputs a print command to the ASIC 24 based on the printing control program. The ASIC 24 drives the driver ICs 30 to 32 based on the print command. For example, the CPU 20 controls the motor driver IC 30 to drive the conveyance motor 33 and thereby convey the recording sheet. The CPU 20 controls the motor driver IC 31 to drive the carriage motor 34 and thereby move the carriage 35. The CPU 20 controls the head driver IC 32 to eject the ink from the recording head 36 mounted on the moving carriage 35 and thereby prints the image data on the recording sheet that is conveyed. In this way, the printing process is performed.

[Overall Operation of MFP]

Figure 3:
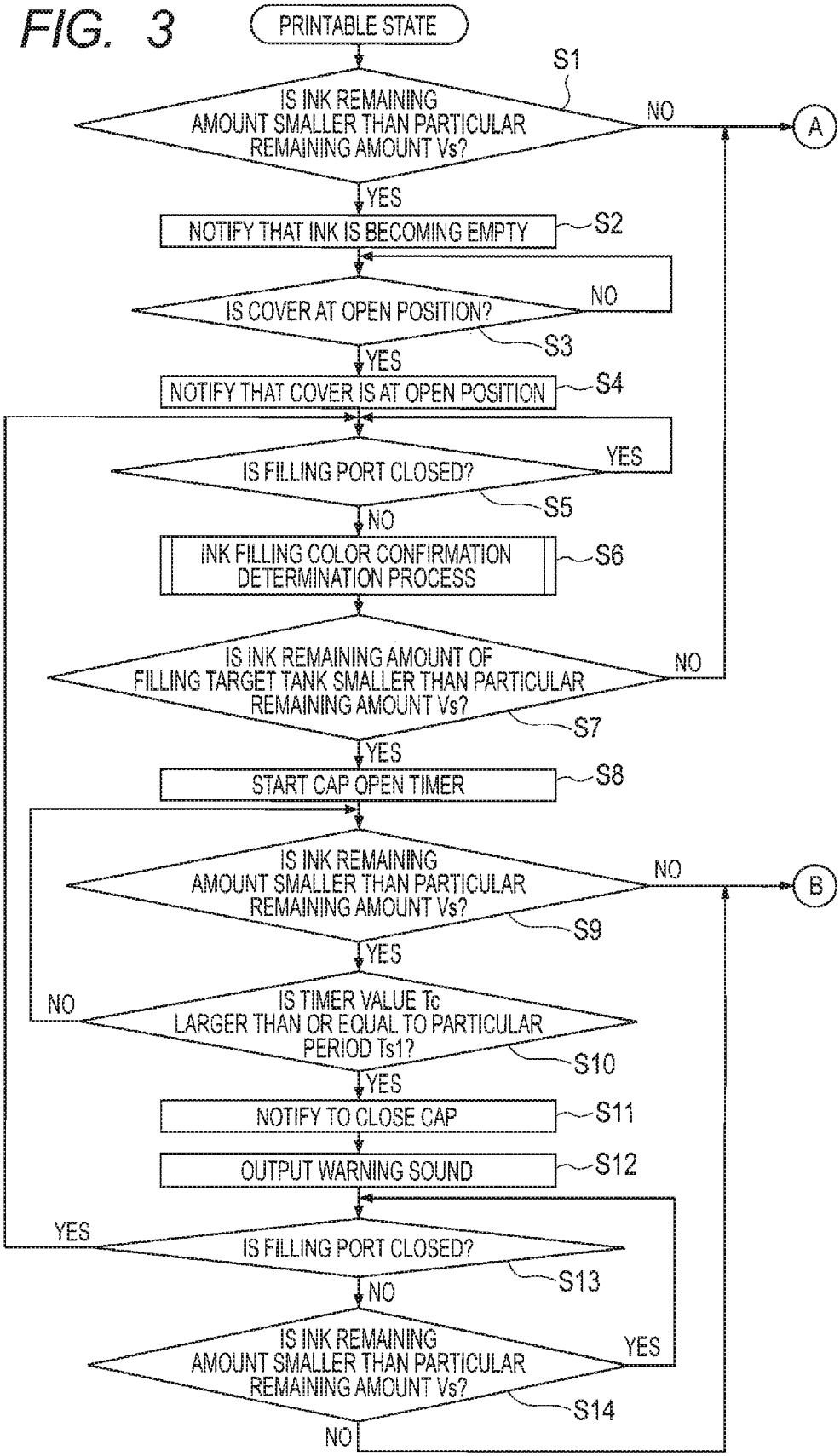
FIG. 3 is a flowchart showing the operation of the MFP in FIG. 1A.
Figure 4:
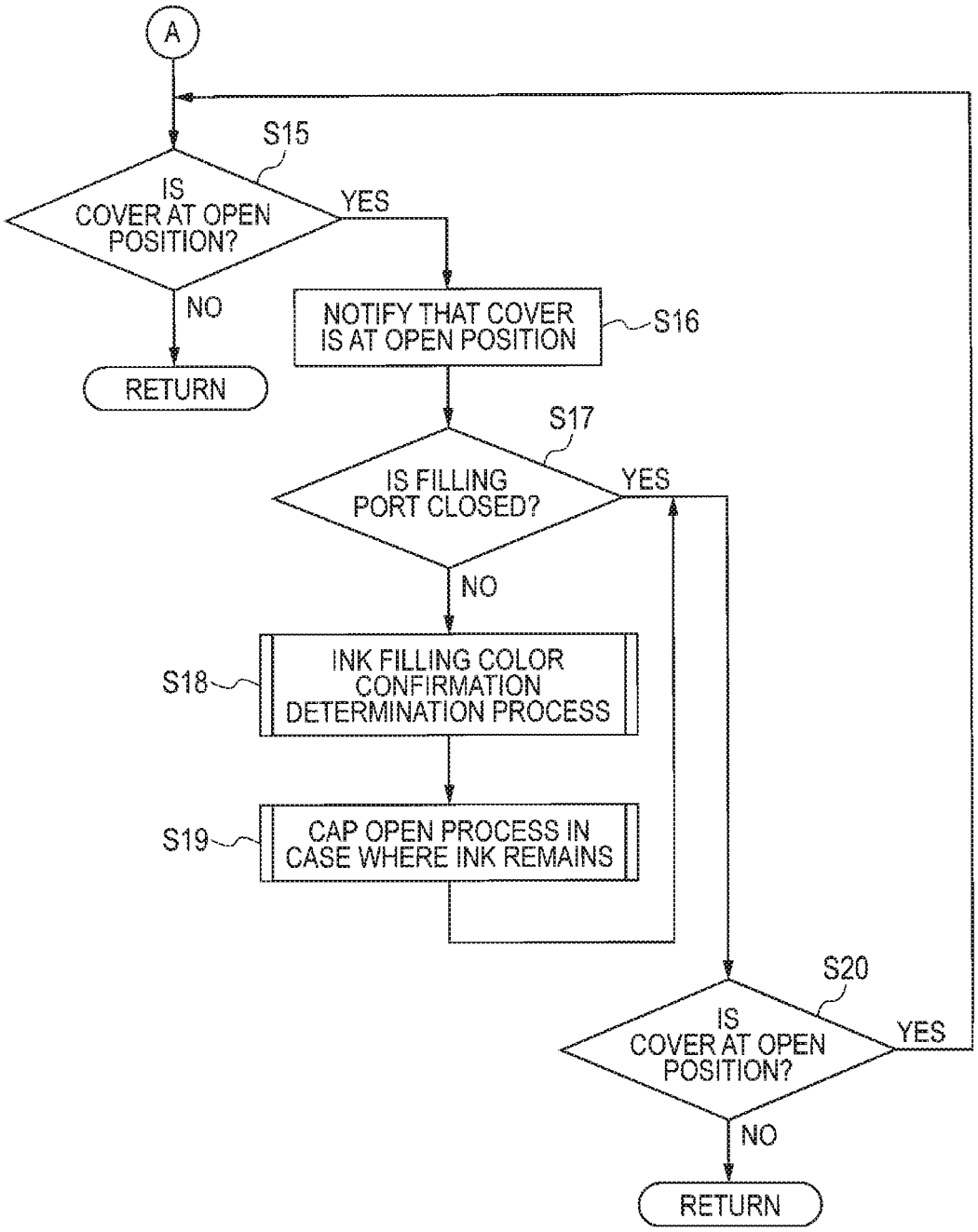
FIG. 4 is a flowchart continuing from the flowchart of FIG. 3.
Figure 5:
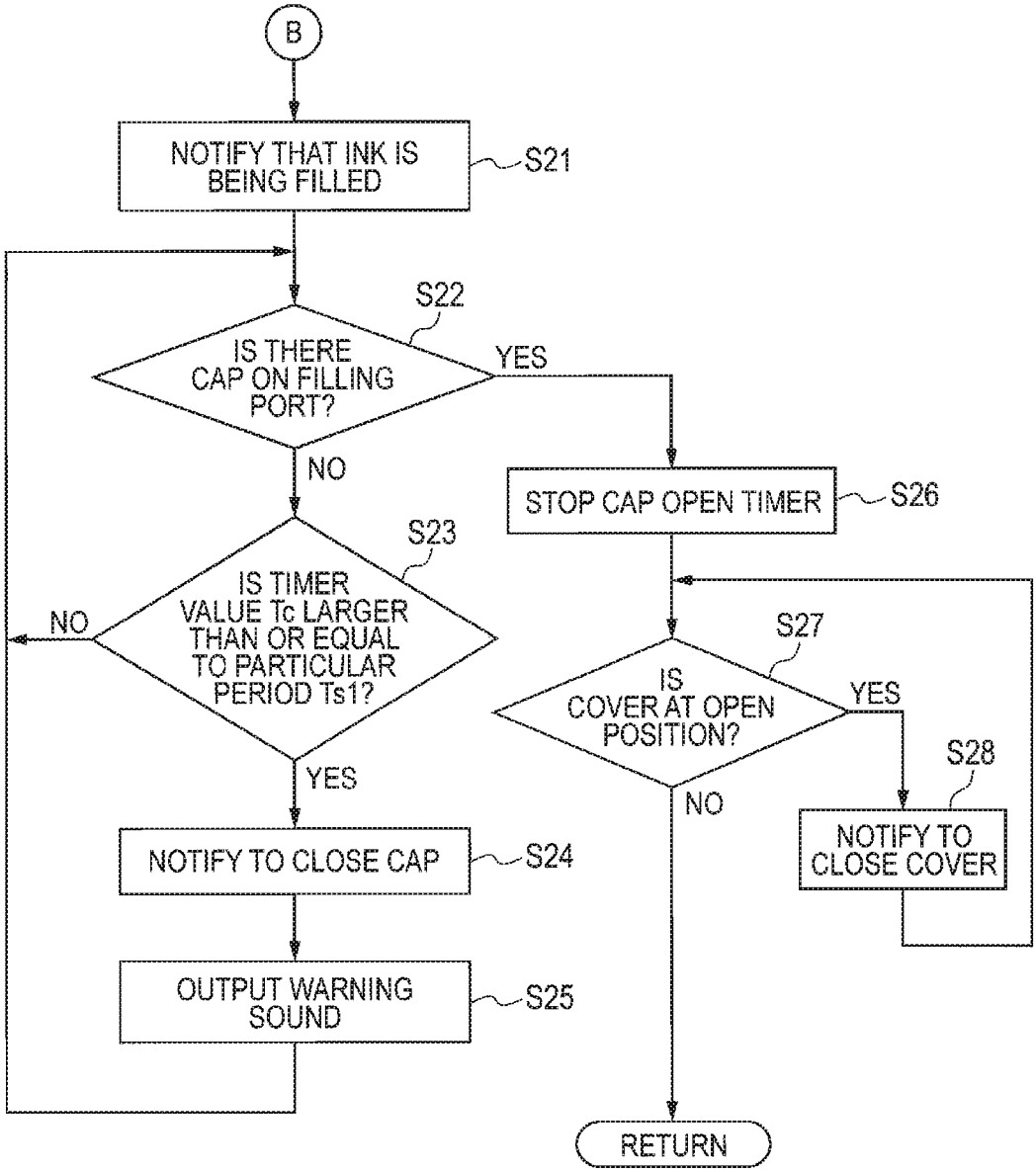
FIG. 5 is another flowchart continuing from the flowchart of FIG. 3.

In the flowcharts shown in FIGS. 3 to 5, although the operations of the MFP 1 are shown for one of the plurality of tanks 12 (the tank 12 storing black ink as one example), the operations of the MFP 1 are similar for the other tanks 12 (the tanks 12 storing cyan, magenta, or yellow ink). In the MFP 1 of the present embodiment, the following process is performed for the tank 12 at which the cap 15 is detached from the filling port 12*a* first in the plurality of tanks 12, as one example.

In response to determining based on a detection signal of the filling port open/close detection sensor 16 that a particular period Ts1 or longer has elapsed in a state where the cap 15 is detached from the filling port 12*a*, the CPU 20 controls the notification device 5 to output a warning to the user.

As shown in FIG. 3, specifically, when the MFP 1 is in a printable state, the CPU 20 determines whether the amount of remaining ink (ink remaining amount) of the tank 12 is smaller than the particular remaining amount Vs based on a detection signal of the ink remaining amount detection sensor 19 (step S1). Hereinafter, step S1 is simply referred to as "S1". The same goes for other steps.

In response to determining in S1 that the ink remaining amount of the tank 12 is not smaller than the particular remaining amount Vs, the CPU 20 advances the step to S15 in FIG. 4. In response to determining in S1 that the ink remaining amount of the tank 12 is smaller than the particular remaining amount Vs, the CPU 20 controls the notification device 5 to notify the user that ink in the tank 12 becomes empty soon and ink needs to be replenished (S2).

Next, the CPU 20 determines whether the cover 11 is at an open position based on a detection signal of the cover detection sensor 18 (S3). In response to determining in S3 that the cover 11 is not at the open position, the CPU 20 returns the step to S3. In S3, in response to determining that the cover 11 is at the open position, the CPU 20 controls the notification device 5 to notify the user that the cover 11 is at the open position (S4).

Next, the CPU 20 determines whether the filling port 12*a* is closed based on a detection signal of the filling port open/close detection sensor 16 (S5). In response to determining in S5 that the filling port 12*a* is closed, the CPU 20 returns the step to S5. In S5, in response to determining that the filling port 12*a* is open, the CPU 20 executes an ink filling color confirmation determination process described later (S6). The ink filling color confirmation determination process is a process for determining an ink filling color (the color of which ink is to be filled) when the filling ports 12*a* of two or more tanks 12 are open.

Next, the CPU 20 determines whether the ink remaining amount of the tank 12 of the ink filling color determined in S6 (the filling target tank 12 to which ink is to be filled) is smaller than the particular remaining amount Vs (S7). That is, there is a possibility that the color determined in S6 is different from the color of the determination target of S5. Thus, in S7, the CPU 20 again determines the ink remaining amount of the tank 12 to fill ink.

In response to determining in S7 that the ink remaining amount of the filling target tank 12 is not smaller than the particular remaining amount Vs, the CPU 20 advances the step to S15 in FIG. 4. In response to determining in S7 that the ink remaining amount of the filling target tank 12 is smaller than the particular remaining amount Vs, the CPU 20 starts a cap open timer (S8).

Next, the CPU 20 determines whether the ink remaining amount of the filling target tank 12 is smaller than the particular remaining amount Vs (S9). In response to determining in S9 that the ink remaining amount of the filling target tank 12 is not smaller than the particular remaining amount Vs, the CPU 20 advances the step to S21 in FIG. 5. In response to determining in S9 that the ink remaining amount of the filling target tank 12 is smaller than the particular remaining amount Vs, the CPU 20 determines whether a timer value Tc of the cap open timer is larger than or equal to a particular period Ts1 (S10). In response to determining in S10 that the timer value Tc is not larger than or equal to the particular period Ts1, the CPU 20 returns the step to S9. In response to determining in S10 that the timer value Tc is larger than or equal to the particular period Ts1, the CPU 20 controls the notification device 5 to notify the user to close the cap 15 (S11) since ink dries and deteriorates, and outputs warning sound (S12).

In this way, after the user detaches the cap 15 from the filling port 12*a*, if the ink remaining amount is smaller than the particular remaining amount Vs although the timer value Tc is larger than or equal to the particular period Ts1, there is a possibility that the tank 12 is left in a state where the cap 15 is detached from the filling port 12*a*. In this case, the CPU 20 executes S11 and S12 to prompt the user to close the cap 15, thereby suppressing ink inside the tank 12 from vaporizing.

Next, the CPU 20 determines whether the filling port 12*a* of the filling target tank 12 is closed (S13). In response to determining in S13 that the filling port 12*a* of the filling target tank 12 is closed, the CPU 20 returns the step to S5. In response to determining in S13 that the filling port 12*a* of the filling target tank 12 is open, the CPU 20 determines whether the ink remaining amount of the filling target tank 12 is smaller than the particular remaining amount Vs (S14).

In response to determining in S14 that the ink remaining amount of the filling target tank 12 is smaller than the particular remaining amount Vs, the CPU 20 returns the step to S13. In response to determining in S14 that the ink remaining amount of the filling target tank 12 is not smaller than the particular remaining amount Vs (that is, in a case where ink has been filled in the tank 12), the CPU 20 advances the step to S21 in FIG. 5.

The case where the CPU 20 advances the step to S21 corresponds to a case where the ink remaining amount of the tank 12 is smaller than the particular remaining amount Vs when the cap 15 is detached from the filling port 12*a*, and thereafter ink is filled into the tank 12 and the ink remaining amount of the tank 12 becomes larger than or equal to the particular remaining amount Vs.

In S21, the CPU 20 controls the notification device 5 to notify the user that ink is currently being filled. Next, the CPU 20 determines whether the cap 15 is attached to the filling port 12*a* (S22). Specifically, the CPU 20 determines that the cap 15 is attached to the filling port 12*a* in response to detecting with the filling port open/close detection sensor 16 that the filling port 12*a* is closed and to detecting with the cap placement area detection sensor 17 that the cap 15 is not placed at the cap placement area 9. In response to determining in S22 that the cap 15 is not attached to the filling port 12*a*, the CPU 20 determines whether the timer value Tc is larger than or equal to the particular period Ts1 (S23). In response to determining in S23 that the timer value Tc is not larger than or equal to the particular period Ts1, the CPU 20 returns the step to S22. In response to determining in S23 that the timer value Tc is larger than or equal to the particular period Ts1, the CPU 20 controls the notification device 5 to notify the user to close the cap 15 (S24), and outputs warning sound (S25). After that, the CPU 20 returns the step to S22. This prevents the filling port 12*a* from being kept open for a long period of time and prevents ink from deteriorating, even though ink is currently being filled.

In response to determining in S22 that the cap 15 is attached to the filling port 12*a*, the CPU 20 stops the cap open timer (S26). After that, the CPU 20 determines whether the cover 11 is at the open position (S27). In response to determining in S27 that the cover 11 is at the open position, the CPU 20 controls the notification device 5 to notify the user to close the cover 11 (S28), and returns the step to S27. This prevents the cover 11 from being left open after ink is filled. In response to determining in S27 that the cover 11 is not at the open position, the CPU 20 returns the flow to the printable state.

The case where the CPU 20 advances the step to S15 corresponds to a case where the ink remaining amount of the tank 12 is already larger than or equal to the particular remaining amount Vs and there is a possibility that the user adds ink. In S15, the CPU 20 determines whether the cover 11 is at the open position. In response to determining in S15 that the cover 11 is not at the open position, the CPU 20 returns the flow to the printable state. That is, this case corresponds to a case where the ink remaining amount of the tank 12 is larger than or equal to the particular remaining amount Vs and the cover 11 is closed.

In response to determining in S15 that the cover 11 is at the open position, the CPU 20 controls the notification device 5 to notify the user that the cover 11 is at the open position (S16). Next, the CPU 20 determines whether the filling port 12*a* is closed (S17). In response to determining in S17 that the filling port 12*a* is closed, the CPU 20 determines whether the cover 11 is at the open position (S20). In response to determining in S20 that the cover 11 is at the open position, the CPU 20 returns the step to S15. In response to determining in S20 that the cover 11 is not at the open position, the CPU 20 returns the flow to the printable state. That is, this case corresponds to a case where the ink remaining amount of the tank 12 is larger than or equal to the particular remaining amount Vs and, although the cover 11 is opened once, the cover 11 is again closed without opening the cap 15.

In response to determining in S17 that the filling port 12*a* is open, the CPU 20 executes the determination process similar to S6 (S18). After that, the CPU 20 executes a cap open process in a case where ink remains (S19) described later, and advances the step to S20. In the cap open process in a case where ink remains (S19), the user is prompted to close the cap 15 when the timer value Tc is larger than or equal to the particular period Ts1, or an ink filling amount is measured when the timer value Tc is smaller than the particular period Ts1. That is, this case corresponds to a case where the ink remaining amount of the tank 12 is larger than or equal to the particular remaining amount Vs, the cover 11 is opened and the cap 15 is detached from the filling port 12*a* of at least one tank 12, and then the cap 15 is again attached to the filling port 12*a*.

[Ink Filling Color Confirmation Determination Process]

Figure 6:
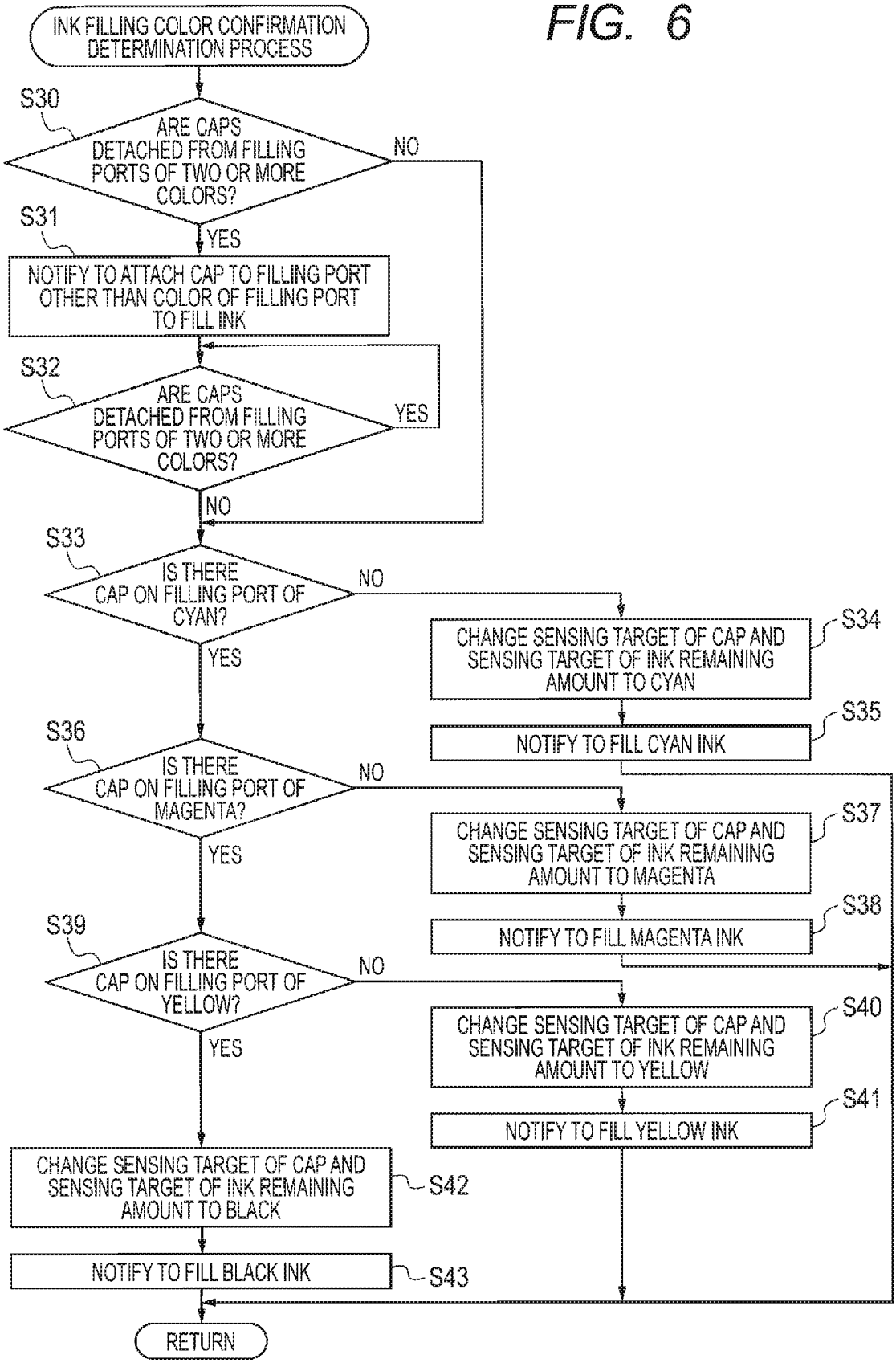
FIG. 6 is a sub-flowchart of an ink filling color confirmation determination process in FIGS. 3 and 4.

In the ink filling color confirmation determination process (S6, S18) shown in FIG. 6, in response to determining based on a detection signal of the filling port open/close detection sensor 16 that the filling ports 12*a* of two or more tanks 12 are open, the CPU 20 controls the notification device 5 to notify the user to make a state where the cap 15 is detached from the filling port 12*a* of only one tank 12.

As shown in FIG. 6, specifically, the CPU 20 determines whether the cap 15 is detached from the filling ports 12*a* of two or more colors, by using the filling port open/close detection sensor 16 and the cap placement area detection sensor 17 provided for each color (S30). Here, the CPU 20 determines whether the cap 15 is detached from the filling ports 12*a* of two or more colors, by performing the process similar to S22 for each of the filling ports 12*a* of the plurality of colors. In response to determining in S30 that the cap 15 is not detached from the filling ports 12*a* of two or more colors, that is, that the number of the cap 15 detached from the filling port 12*a* is one, the CPU 20 performs S33.

In response to determining in S30 that the cap 15 is detached from the filling ports 12*a* of two or more colors, the CPU 20 controls the notification device 5 to notify the user to attach the cap 15 to the filling port 12*a* other than the color of the filling port 12*a* to fill ink (S31). Then, the CPU 20 performs a process similar to S30 (S32). The CPU 20 performs S32 until the number of the filling port 12*a* from which the cap 15 is detached becomes one. In response to determining that the cap 15 is attached to the filling port 12*a* other than the color of the filling port 12*a* of the tank 12 to fill ink, the CPU 20 performs S33.

In S33, the CPU 20 determines whether the cap 15 is attached to the filling port 12*a* of the tank 12 storing cyan ink (S33). In response to determining in S33 that the cap 15 is attached to the filling port 12*a* of cyan, the CPU 20 determines whether the cap 15 is attached to the filling port 12*a* of the tank 12 storing magenta ink (S36).

In response to determining in S36 that the cap 15 is attached to the filling port 12*a* of magenta, the CPU 20 determines whether the cap 15 is attached to the filling port 12*a* of the tank 12 storing yellow ink (S39). In response to determining in S39 that the cap 15 is attached to the filling port 12*a* of yellow, the CPU 20 changes the tank 12 to detect the sensing-target cap 15 and the tank 12 to detect the sensing-target ink remaining amount to the tank 12 storing black ink (S42). After that, the CPU 20 controls the notification device 5 to notify the user to fill ink into the tank 12 storing black ink (S43), and returns the flow.

In response to determining in S33 that the cap 15 is not attached to the filling port 12*a* of the tank 12 storing cyan ink, the CPU 20 changes the tank 12 to detect the sensing-target cap 15 and the tank 12 to detect the sensing-target ink remaining amount to the tank 12 storing cyan ink (S34). After that, the CPU 20 controls the notification device 5 to notify the user to fill ink into the tank 12 storing cyan ink (S35), and returns the flow.

In response to determining in S36 that the cap 15 is not attached to the filling port 12*a* of the tank 12 storing magenta ink, the CPU 20 changes the tank 12 to detect the sensing-target cap 15 and the tank 12 to detect the sensing-target ink remaining amount to the tank 12 storing magenta ink (S37). After that, the CPU 20 controls the notification device 5 to notify the user to fill ink into the tank 12 storing magenta ink (S38), and returns the flow.

In response to determining in S39 that the cap 15 is not attached to the filling port 12*a* of the tank 12 storing yellow ink, the CPU 20 changes the tank 12 to detect the sensing-target cap 15 and the tank 12 to detect the sensing-target ink remaining amount to the tank 12 storing yellow ink (S40). After that, the CPU 20 controls the notification device 5 to notify the user to fill ink into the tank 12 storing yellow ink (S41), and returns the flow.

In this way, in the determination processes (S6, S18), when the cap 15 is not attached to the filling port 12*a* of two or more tanks 12, one color to fill ink is determined. This suppresses a situation that the filling ports 12*a* of two or more tanks 12 are open at the same time and that vaporization of ink in the tank 12 advances. This also prevents filling ink of a wrong color into the tank 12 by mistake.

In the determination processes (S6, S18) of the present embodiment, the steps are executed for the tanks 12 storing cyan, magenta, and yellow ink in this sequence. However, the sequence of the steps is not limited to this, and the sequence of the ink colors may be changed appropriately.

[Cap Open Process in Case where Ink Remains]

In the cap open process shown in FIG. 7, in response to determining based on detection signals of the filling port open/close detection sensor 16, the cap placement area detection sensor 17, and the ink remaining amount detection sensor 19 that the ink remaining amount of the tank 12 is larger than or equal to the particular remaining amount Vs and that the cap 15 is detached from the filling port 12*a* and again attached to the filling port 12*a*, the CPU 20 estimates an ink filling amount based on a period from when the cap 15 is detached from the filling port 12*a* until when the cap 15 is again attached to the filling port 12*a*, and stores the ink filling amount in the RAM 22.

As shown in FIG. 7, specifically, the CPU 20 starts the cap open timer (S50), and determines whether the timer value Tc is larger than or equal to the predetermined particular period Ts2 (S51). The particular period Ts2 is shorter than a minimum period assumed to be required for a user to perform a series of operations from detaching the cap 15 from the filling port 12*a* to inserting the ink replenishment bottle 90 into the filling port 12*a*. The particular period Ts2 is set to a period shorter than the particular period Ts1. The particular periods Ts1 and Ts2 may be set appropriately. For example, the particular period Ts1 may be set to several minutes, and the particular period Ts2 may be set to several tens of seconds.

In response to determining in S51 that the timer value Tc is not larger than or equal to the particular period Ts2, the CPU 20 determines whether the cap 15 is attached to the filling port 12*a* (S52). When the timer value Tc is smaller than the particular period Ts2, it is impossible for the user to insert the ink replenishment bottle 90 into the filling port 12*a* in this short period. Thus, when it is detected by the filling port open/close detection sensor 16 in S51 that the filling port 12*a* is closed, the CPU 20 determines that the filling port 12*a* is closed by the cap 15 and that the cap 15 exists at the filling port 12*a*. In response to determining in S52 that the cap 15 is attached, the CPU 20 stops the cap open timer (S57), and returns the flow. That is, this case corresponds to a case where the ink remaining amount of the tank 12 is larger than or equal to the particular remaining amount Vs and where the user detaches the cap 15 from the filling port 12*a* and again attaches the cap 15 to the filling port 12*a* in a short period of time. In response to determining in S52 that the cap 15 is not attached, the CPU 20 returns the step to S51.

Next, in response to determining in S51 that the timer value Tc is larger than or equal to the particular period Ts2, the CPU 20 determines whether the timer value Tc is larger than or equal to the particular period Ts1 (S53). In response to determining in S53 that the timer value Tc is larger than or equal to the particular period Ts1, the CPU 20 controls the notification device 5 to notify the user to close the cap 15 since ink dries and deteriorates (S54), and outputs warning sound (S55).

Next, the CPU 20 determines whether the cap 15 is attached to the filling port 12*a* (S56). In response to determining in S56 that the cap 15 is not attached to the filling port 12*a*, the CPU 20 returns the step to S53. In response to determining in S56 that the cap 15 is attached to the filling port 12*a*, the CPU 20 stops the cap open timer (S57), and returns the flow.

In a case where the ink remaining amount of the tank 12 is larger than or equal to the particular remaining amount Vs and where the user intends to add ink to the tank 12, the above-described step prevents the filling port 12*a* from being kept open for a long period of time and prevents ink from deteriorating.

In response to determining in S53 that the timer value Tc is not larger than or equal to the particular period Ts1, the CPU 20 determines whether there is a sensor reaction at the filling port 12*a*, that is, whether the filling port 12*a* is closed, based on a detection signal of the filling port open/close detection sensor 16 (S58). In response to determining in S58 that there is no sensor reaction at the filling port 12*a*, that is, that the filling port 12*a* is open, the CPU 20 returns the step to S53.

Next, in response to determining in S58 that there is a sensor reaction at the filling port 12*a*, that is, that the filling port 12*a* is closed, the CPU 20 determines whether the cap 15 is placed at the cap placement area 9 based on a detection signal of the cap placement area detection sensor 17 (S59). In response to determining in S59 that the cap 15 is not placed at the cap placement area 9, that is, the sensor reaction detected in S58 is caused by the cap 15 and hence the filling port 12*a* is closed by the cap 15, the CPU 20 advances the step to S57. In response to determining in S59 that the cap 15 is placed at the cap placement area 9, that is, the sensor reaction detected in S58 is caused by the ink replenishment bottle 90 and hence the ink replenishment bottle 90 is inserted in the filling port 12*a*, the CPU 20 controls the notification device 5 to notify the user that ink is currently being filled (S60), and starts the ink filling amount measurement timer (S61).

That is, the case where the CPU 20 determines in S58 that there is a sensor reaction at the filling port 12*a* and determines in S59 that the cap 15 is placed at the cap placement area 9 corresponds to the case where ink is being filled into the tank 12 through the filling port 12*a* from the bottle opening of the ink replenishment bottle 90. Thus, by starting the ink filling amount measurement timer in S61, the CPU 20 calculates the ink filling amount to the tank 12 based on measurement period of the ink filling amount measurement timer.

Next, the CPU 20 determines whether there is a sensor reaction at the filling port 12*a* based on the detection signal of the filling port open/close detection sensor 16 (S62). The CPU 20 continues measurement by the ink filling amount measurement timer while determining in S62 that there is a sensor reaction at the filling port 12*a*. In response to determining in S62 that there is no sensor reaction at the filling port 12*a*, the CPU 20 stops the ink filling amount measurement timer (S63). By these steps, the ink filling period is measured.

After that, the CPU 20 multiplies a count value of the ink filling amount measurement timer (the ink filling period) by a preliminarily-obtained ink filling rate from the ink replenishment bottle 90 to the tank 12, thereby calculating the ink filling amount to the tank 12 (S64).

Next, the CPU 20 subtracts the ink filling period from the measurement period of the cap open timer started in S50, thereby correcting the measurement period (S65). This prevents warning sound from being outputted due to a fact that the timer value Tc is larger than or equal to the particular period Ts1, although ink is currently being filled into the tank 12. After that, the CPU 20 controls the notification device 5 to notify the user about the ink filling amount which is the calculation result in S64 (S66).

Next, the CPU 20 determines whether the cap 15 is placed at the cap placement area 9 based on the detection signal of the cap placement area detection sensor 17 (S67). In response to determining in S67 that the cap 15 is placed at the cap placement area 9, the CPU 20 returns the step to S67. In response to determining in S67 that the cap 15 is not placed at the cap placement area 9, the CPU 20 determines whether the cap 15 is attached to the filling port 12*a* (S68). Specifically, the CPU 20 determines whether the filling port 12*a* is closed, by using the filling port open/close detection sensor 16. In response to detecting that the filling port 12*a* is closed, the CPU 20 determines that the cap 15 is attached to the filling port 12*a*. In response to determining in S68 that the cap 15 is not attached to the filling port 12*a*, the CPU 20 returns the step to S68. In response to determining in S68 that the cap 15 is attached to the filling port 12*a*, the CPU 20 advances the step to S57.

The correction of the measurement period of the cap open timer is not limited to the calculation method in S65. For example, the CPU 20 may temporarily stop the measurement of the timer in response to determining that ink in the tank 12 is larger than or equal to the particular remaining amount Vs based on the detection signal of the ink remaining amount detection sensor 19, and may restart the measurement of the time in response to determining that filling of ink into the tank 12 is completed based on the detection signals of the filling port open/close detection sensor 16 and the cap placement area detection sensor 17.

The CPU 20 may start the ink filling amount measurement timer in response to determining that the cap 15 is placed at the cap placement area 9 based on the detection signal of the cap placement area detection sensor 17, and may stop the timer in response to determining that the cap 15 is not placed at the cap placement area 9, thereby measuring the ink filling period.

As described above, according to the MFP 1, in response to determining based on the detection signal of the filling port open/close detection sensor 16 that the particular period Ts1 or longer has elapsed in a state where the cap 15 is detached from the filling port 12*a*, the CPU 20 controls the notification device 5 to output warning to the user. This prevents the user from forgetting closing the filling port 12*a* with the cap 15.

In response to determining based on the detection signals of the filling port open/close detection sensor 16, the cap placement area detection sensor 17, and the ink remaining amount detection sensor 19 that the ink remaining amount of the tank 12 is smaller than the particular remaining amount Vs when the cap 15 is detached from the filling port 12*a* and that the particular period Ts1 or longer has elapsed since the cap 15 is detached from the filling port 12*a*, the CPU 20 controls the notification device 5 to output warning to the user, regardless of whether ink has been filled into the tank 12. This prevents continuing of a state where the cap 15 is detached from the filling port 12*a* and hence prevents viscosity of ink from increasing.

In response to determining based on the detection signals of the filling port open/close detection sensor 16, the cap placement area detection sensor 17, and the cover detection sensor 18 that the particular period Ts1 or longer has elapsed in a state where the cover 11 is at the open position and the cap 15 is detached from the filling port 12*a*, the CPU 20 controls the notification device 5 to output warning to the user. This prevents continuing of a state where the user opens the cover 11 and the cap 15 is detached from the filling port 12*a*.

In response to determining based on the detection signals of the filling port open/close detection sensor 16, the cap placement area detection sensor 17, and the ink remaining amount detection sensor 19 that the ink remaining amount of the tank 12 is larger than or equal to the particular remaining amount Vs and the cap 15 is detached from the filling port 12*a* and again attached to the filling port 12*a*, the CPU 20 estimates the ink filling amount based on a period before the cap 15 is detached from the filling port 12*a* until the cap 15 is again attached to the filling port 12*a*, and stores the ink filling amount in the RAM 22. Thus, the CPU 20 easily manages the ink filling amount.

In response to determining based on the detection signal of the filling port open/close detection sensor 16 that the cap 15 is detached from the filling port 12*a* of two or more tanks 12, the CPU 20 controls the notification device 5 to notify the user to make a state where the cap 15 is detached from the filling port 12*a* of only one of the plurality of tanks 12. This prevents two or more filling ports 12*a* from being opened at the same time, and prevents vaporization of ink in each tank 12 from advancing at the same time. This further prevents ink of a wrong color from being filled into the tank 12 by mistake.

While the disclosure has been described in detail with reference to the above aspects thereof, it would be apparent to those skilled in the art that various changes and modifications may be made therein without departing from the scope of the claims.

In the above-described embodiment, the CPU 20 performs determinations in S23 and S53 based on the same particular period Ts1. However, determinations may be performed based on different particular periods. In this case, for example, it is preferable that the particular period in S23 be set to a longer value than the particular period in S53.

While controlling the notification device 5 to output warning to the user, the CPU 20 may disallow a recording operation by the printer unit 2. In this case, the user is effectively prompted to attach the cap 15 to the filling port 12*a*.

In the above-described embodiment, it is determined whether the cap 15 is attached to the filling port 12*a*, by using the filling port open/close detection sensor 16 and the cap placement area detection sensor 17. However, the filling port open/close detection sensor 16 may be configured to detect an open/close state of the filling port 12*a*, and also configured to distinguish whether the filling port 12*a* is closed by the cap 15 or is closed by the ink replenishment bottle 90. In this case, it is determined whether the cap 15 is attached to the filling port 12*a*, by using only the filling port open/close detection sensor 16.

The image recording apparatus of this disclosure is not limited to an MFP, and may be applied to various apparatuses that record images by using ink stored in a tank.

What is claimed is:

1. An image recording apparatus comprising:

a tank configured to store ink therein, the tank being formed with a filling port for filling ink;

a cap configured to be attached to the filling port so as to close the filling port;

a cap detector configured to detect whether the cap is attached to the filling port;

a notification device configured to output particular information;

an ink remaining amount detection sensor configured to detect whether an ink remaining amount of the tank is smaller than a particular amount; and a controller configured to control the notification device to output a warning, in response to determining based on a detection signal of the cap detector that a particular period or longer has elapsed in a state where the cap is detached from the filling port, wherein the controller is configured to control the notification device to output a warning in response to determining based on detection signals of the cap detector and the ink remaining amount detection sensor that the ink remaining amount of the tank is smaller than the particular amount when the cap is detached from the filling port and that the particular period or longer has elapsed since the cap is detached from the filling port, regardless of whether ink has been filled into the tank.

2. The image recording apparatus according to claim 1, further comprising:

a cover configured to move relative to the tank between a closed position for closing the filling port and the cap attached to the filling port, and an open position for exposing the filling port and the cap attached to the filling port; and a cover detection sensor configured to detect whether the cover is at the open position or at the closed position, wherein the controller is configured to control the notification device to output a warning, in response to determining based on detection signals of the cap detector and the cover detection sensor that the particular period or longer has elapsed in a state where the cover is at the open position and the cap is detached from the filling port.

3. The image recording apparatus according to claim 1, further comprising a recorder controlled by the controller and configured to record an image on a recording sheet, wherein the controller is configured to disallow a recording operation by the recorder while the notification device outputs the warning.

4. The image recording apparatus according to claim 1, further comprising a memory, wherein the controller is configured to, in response to determining based on detection signals of the cap detector and the ink remaining amount detection sensor that the ink remaining amount of the tank is larger than or equal to the particular amount and that the cap is detached from the filling port and again attached to the filling port, estimate an ink filling amount based on a period from when the cap is detached from the filling port until when the cap is again attached to the filling port; and store the ink filling amount in the memory.

5. The image recording apparatus according to claim 1, wherein the tank comprises a plurality of tanks; and wherein the controller is configured to, in response to determining based on a detection signal of the cap detector that the cap is detached from the filling port of two or more tanks of the plurality of tanks, control the notification device to output a notification prompting to make a state where the cap is detached from the filling port of only one of the plurality of tanks.

6. The image recording apparatus according to claim 1, further comprising a cap placement area at which the cap detached from the filling port is placed, wherein the cap detector comprises:

a filling port detection sensor configured to detect whether the filling port of the tank is open or closed; and a cap placement area detection sensor configured to detect whether the cap is placed at the cap placement area;

wherein the controller is configured to determine that the cap is attached to the filling port, in response to detecting that the filling port is closed by using the filling port detection sensor and to detecting that the cap is not placed at the cap placement area by using the cap placement area detection sensor; and wherein the controller is configured to determine that an ink replenishment bottle is inserted in the filling port, in response to detecting that the filling port is closed by using the filling port detection sensor and to detecting that the cap is placed at the cap placement area by using the cap placement area detection sensor.

7. The image recording apparatus according to claim 6, wherein the controller is configured to serve as a cap open timer that measures a cap open period from when the filling port is opened until when the filling port is closed, based on detection signals of the filling port detection sensor; and in response to determining that the cap open period is shorter than another particular period, the controller determines that the filling port is closed by the cap.

8. The image recording apparatus according to claim 7, wherein the controller is further configured to serve as an ink filling amount measurement timer that measures an ink filling period during which the ink replenishment bottle is inserted in the filling port, based on detection signals of the filling port detection sensor and the cap placement area detection sensor; and wherein the controller is configured to subtract the ink filling period from the cap open period, thereby correcting the cap open period and preventing the warning from being outputted.

9. An image recording apparatus comprising:

a tank configured to store ink therein, the tank being formed with a filling port for filling ink;

a cap configured to be attached to the filling port so as to close the filling port;

a cap detector configured to detect whether the cap is attached to the filling port;

a notification device configured to output particular information;

an ink remaining amount detection sensor configured to detect whether an ink remaining amount of the tank is smaller than a particular amount; and a controller configured to control the notification device to output a warning, in response to determining based on a detection signal of the cap detector that a particular period or longer has elapsed in a state where the cap is detached from the filling port, wherein the controller is configured to control the notification device to output a notification that ink is currently being filled, in response to determining that the ink remaining amount is smaller than the particular amount when the cap is detached from the filling port, and thereafter ink is filled into the tank and the ink remaining amount becomes larger than or equal to the particular amount, based on detection signals of the ink remaining amount detection sensor.

* * * * *